US007158110B2

(12) United States Patent
Inoue

(10) Patent No.: US 7,158,110 B2
(45) Date of Patent: Jan. 2, 2007

(54) DIGITAL IMAGE PROCESSING DEVICE

(75) Inventor: Toshiaki Inoue, Tokyo (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 10/810,618

(22) Filed: Mar. 29, 2004

(65) Prior Publication Data

US 2004/0189648 A1 Sep. 30, 2004

(30) Foreign Application Priority Data

Mar. 28, 2003 (JP) ..... 2003-090064

(51) Int. Cl.
*G09G 3/36* (2006.01)
*G09G 5/36* (2006.01)

(52) U.S. Cl. ..... 345/93; 345/98; 345/545

(58) Field of Classification Search ..... 345/501, 345/547, 545, 3.3, 3.4, 204, 205, 698, 904, 345/530, 559, 93, 98, 100; 348/245
See application file for complete search history.

(56) References Cited

U.S. PATENT DOCUMENTS 4,639,890 A * 1/1987 Heilveil et al. ..... 345/559
4,785,349 A * 11/1988 Keith et al. ..... 375/240.23
5,060,059 A * 10/1991 Mori et al. ..... 358/529
5,305,122 A * 4/1994 Hayashi et al. ..... 358/530
5,736,972 A * 4/1998 Kitagishi et al. ..... 345/99
5,896,140 A * 4/1999 O'Sullivan ..... 345/536
6,870,542 B1 * 3/2005 Toksvig et al. ..... 345/531
2002/0130974 A1 * 9/2002 Kimura et al. ..... 348/615
2003/0197672 A1 * 10/2003 Yun et al. ..... 345/99

OTHER PUBLICATIONS

Bigelow, Ken. "Parallel-to-Serial Shift Register." http://www.play-hookey.com/digital/shift-out_register.html.*
μPD16341/A, 96-bit AC-PDP driver, Material No. S14076JJ5V0PM00 (Fifth Edition), Jun. 1999.

* cited by examiner

*Primary Examiner*—Ulka Chauhan
*Assistant Examiner*—Joni Hsu
(74) *Attorney, Agent, or Firm*—Drinker Biddle & Reath LLP

(57) ABSTRACT

A low-cost digital image processing device constructed by using a simplified circuit is provided which is capable of reducing an amount of data of an image to be stored in a frame memory and of being applied to a display panel with a desired level of a resolution. In the digital image processing device, a video input signal is processed in a signal processing unit and is stored in a frame memory as image data. The frame memory is installed to play a role as, for example, a double buffer to smooth out transfer speed discrepancies between a video input signal and a video output signal. Dummy data is embedded in an image data read from the frame memory by a redundant pixel embedding section and the image data is fed to a display panel as a video output signal.

14 Claims, 5 Drawing Sheets

DIGITAL IMAGE PROCESSING DEVICE

BACKGROUND OF THE INVENTION

1. Field of the Invention

The present invention relates to a digital image processing device and more particularly to the digital image processing device to feed image data to an image display device.

The present application claims priority of Japanese Patent Application No. 2003-090064 filed on Mar. 28, 2003, which is hereby incorporated by reference.

2. Description of the Related Art

Resolutions being employed in a digital image processing device includes, for example, in the case of a color-display plasma display panel, many levels of resolutions mainly such as WVGA (Wide-Video Graphics Array) providing 2559 pixels×480 lines, HD (High-Definition) providing 3072 pixels×768 lines, and WXGA (Wide-Extended Graphics Array) providing 4095 pixels×768 lines and such the resolutions tend to increase in level. To supply a display panel at a low cost, a method is employed in which, by achieving commonality of specifications of components including a comparatively high-cost driving circuit (that is, a data driver, thereafter being simply called a "driver") or a like, a digital image processing device can be applied to various display panels.

FIGS. 5A, 5B, and 5C are diagrams showing examples of methods for connecting various display panels to drivers in which examples of arrangement of the drivers 501 each being made up of, for example, 96 pixels and being able to operate all image lines included in various display panels. If the driver 501 is commonly used for connecting display panels with different resolutions, that is, the display panel 502 with WXGA resolutions, display panel 503 with HD resolutions, and display panel 504 with WVGA resolutions, in the case of the display panel 503 with HD resolutions, as shown in FIG. 5B, resolutions in a horizontal direction can be realized by fully using the driver 501 having 96 pixels. However, in the display panel 502 with WXGA resolutions and the display panel 504 with WVGA resolutions, as shown in FIG. 5A and FIG. 5C, unused pixels are left.

Moreover, the driver 501 is so constructed ordinarily that, in order to reduce the number of input terminals, after image data has been captured from 2 to 4 pieces of input terminals in a time-series manner, 96 pixels are output in parallel (for example, uPD16341/A, 96-bit AC-PDP driver, Material number S14076JJ5V0PM00 (Fifth edition), June 1999).

Therefore, for example, in the case of the display panel 502 with WXGA resolutions and the display panel 504 with WVGA resolutions, it is necessary that data (hereafter, being referred as a "redundant pixel" or "dummy data") corresponding to portions being not connected between the display panel 502 or the display panel 504 and the driver 501 has to be embedded in an image line to be transferred to the driver 501. Due to this, there are some cases in which a length of an image line to be transferred to a driver is longer than that to be actually displayed on a display panel. Moreover, a position in which dummy data is embedded and the number of pixels are varied depending on types of drivers. In recent years, 192-bit and 256-bit drivers, besides 96-bit driver, are commercially available.

FIG. 6 is a block diagram showing an example of configurations of a conventional digital image processing device. In a video input signal 601, after the video input signal 601 has been processed by a signal processing section 602, is embedded dummy data which corresponds to resolutions of a display panel to be used, by a redundant pixel embedding section 603. The image line in which dummy data is embedded, after having been stored in a frame memory 604, is transferred to each of drivers 605 in a time-series manner and is then displayed in a display panel 606 (with WXGA resolutions).

In a conventional image processing device, in order to transfer an image line containing dummy data which corresponds to a resolution of a display panel to a driver, in the case of, for example, a display panel with WXGA resolutions, as shown in FIG. 6, dummy data has been, in advance, embedded by the redundant pixel embedding section 603 in an output image line each having 4095 pixels in the signal processing section 602 so that the number of pixels becomes 4224 and the data having 4224 pixels is stored in the frame memory 604. Thus, by having the redundant pixel embedding section 603 embed dummy data corresponding to a resolution of a display panel, the digital image processing device can be applied to a display panel with a different resolution.

Moreover, so far as a research on prior art performed within a range of ordinary efforts is concerned, no information about references concretely describing contents of the above described conventional technology is obtained.

However, the conventional digital image processing device has problems. That is, a first problem associated with the conventional digital image processing device is an increase in a capacity of a frame memory. This occurs because a redundant image line having embedded dummy data which is not actually displayed is stored into a frame memory, that is, for example, if a display panel with WXGA resolutions uses a 96-bit driver, capacity being equivalent to about 3% of a total capacity of the frame memory is used for dummy data which is not displayed.

A second problem associated with the conventional digital image processing is an increase in an amount of hardware. This occurs because both a function of embedding dummy data in an image line and a function of transferring data to a driver of a display panel in a time-series manner have to be individually designed.

SUMMARY OF THE INVENTION

In view of the above, it is an object of the present invention to provide a digital image processing device using a simplified circuit which is capable of eliminating waste in storing dummy data in a frame memory and of being applied to a display panel employing a combination of a desired level of a resolution and any type of driver.

According to a first aspect of the present invention, there is provided a digital image processing device including:

a signal processing unit to process a video input signal;

a frame memory to store a result from the processing performed by the signal processing unit; and a redundant pixel embedding circuit to embed a redundant pixel not to be displayed in an image line read from the frame memory and to produce a video output signal.

In the foregoing, a preferable mode is one wherein the redundant pixel embedding circuit has a function of receiving, as an input, an image line read from the frame memory and of embedding, according to an embedding control signal fed from outside, a redundant pixel in a specified position in the image line.

Thus, in the digital image processing device of the present invention, dummy data is embedded not in data output from a signal processing unit but in an image line read from the frame memory. Therefore, storing dummy data not to be displayed in the frame memory is not required.

According to a second aspect of the present invention, there is provided a digital image processing device including:

a signal processing unit to process a video input signal;

a frame memory to store a result from the processing performed by the signal processing unit;

a serial-parallel converting circuit to receive image data read from the frame memory in a time-series manner and to produce an output making up an image line, a redundant pixel embedding circuit to embed a redundant pixel not to be displayed in the image line and to output data, and a parallel-serial converting circuit to output the image line in which the redundant pixel is embedded as time-series image data.

In the foregoing, a preferable mode is one wherein the serial-parallel converting circuit which is made up of a register file being able to store an image line and which has a function of sequentially storing image data fed from the frame memory in a time-series manner according to a writing control signal fed from outside and of reading, simultaneously and in parallel, contents of all registers in the register file.

Also, a preferable mode is one wherein the redundant pixel embedding circuit has a function of receiving, as an input, an image line read from the serial-parallel converting circuit and of embedding, according to an embedding control signal fed from outside, a redundant pixel in a specified position in the image line.

Also, a preferable mode is one wherein the parallel-serial converting circuit has a register file made up of two or more shift registers and a selector to select an output from each of the shift registers and to output the selected output and wherein the register file is able to store an image line in one clock cycle and wherein each of the shift registers is able to perform a shifting operation, according to a reading control signal fed from outside, in synchronization with a clock signal and wherein the selector has a function of selecting a specified shift output from the shift register and of outputting the selected output according to an embedding control signal fed from outside.

Furthermore, a preferable mode is one wherein each of the shift registers is made up of two or more split shift registers and wherein each of the split shift registers receives a data input, shift data input, latch signal input, and shift signal input and produces a shift data output and wherein each of the shift registers has a function of writing, when data is to be written to the split shift registers, data at one time, by making active a latch signal input, in synchronization with a clock and, at time of shifting operations, of performing the shifting operation for data, by making active a shift signal input, in synchronization with a clock and of feeding a shift output fed from each of the split shift registers to the selector by connecting a terminal for a shift output from each of the split shift registers to a terminal for a shift input of each of adjacent split shift registers to allow the shift register to perform the shift operation as a whole.

Thus, in the digital image processing device of the present invention, dummy data is embedded, in parallel, in an image line (one horizontal line) based on connection theory and the output is transferred, by using a shift register, to a data driver in a time-series manner. Therefore, both a function of embedding dummy data and a function of transferring data in a time-series manner to a driver of a display panel can be realized using simplified hardware and the present invention can be applied to a display panel having a combination of a desired level of resolution and any type of driver.

With the above configurations, it is made possible to decrease a required capacity of a frame memory and to reduce costs for components to be used as a frame memory and power consumption. This can be achieved because storing of dummy data not to be displayed in the frame memory is not required.

With another configuration, it is made possible to decrease an amount of hardware required in an output circuit for a data driver and to minimize a chip area (or costs) required when being incorporated in large-scale integrated circuits and to reduce power consumption. This can be achieved because both a function of embedding dummy data and a function of transferring data to a driver of a display panel in a time-series manner can be realized using simplified hardware and the digital image processing device can be applied to a combination of a desired level of a resolution employed in the display panel and any type of driver employed in the display panel.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

Embodiment

Figure 1:
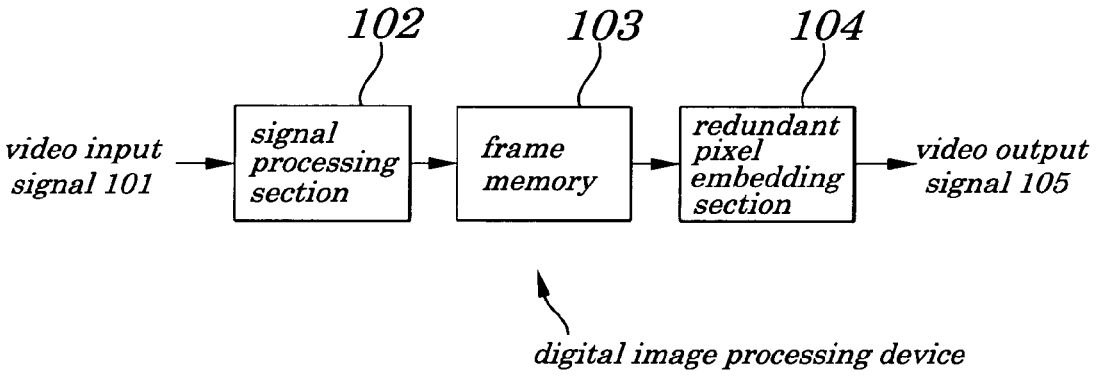
FIG. 1 is a block diagram showing basic configurations of a digital image processing device according to one embodiment of the present invention.
Figure 2:
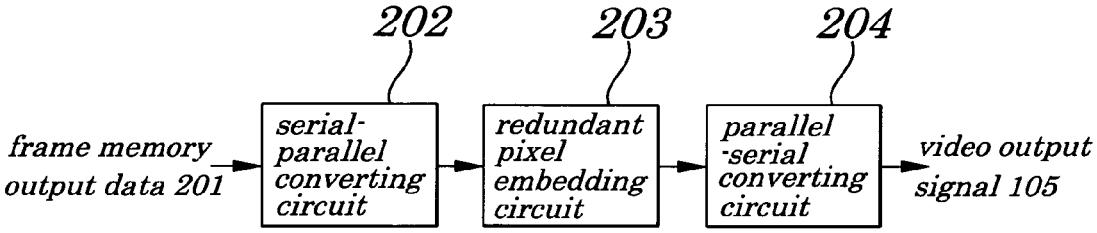
FIG. 2 is a diagram showing detailed configurations of a redundant image embedding section in the digital image processing device according to the embodiment of the present invention.
Figure 3:
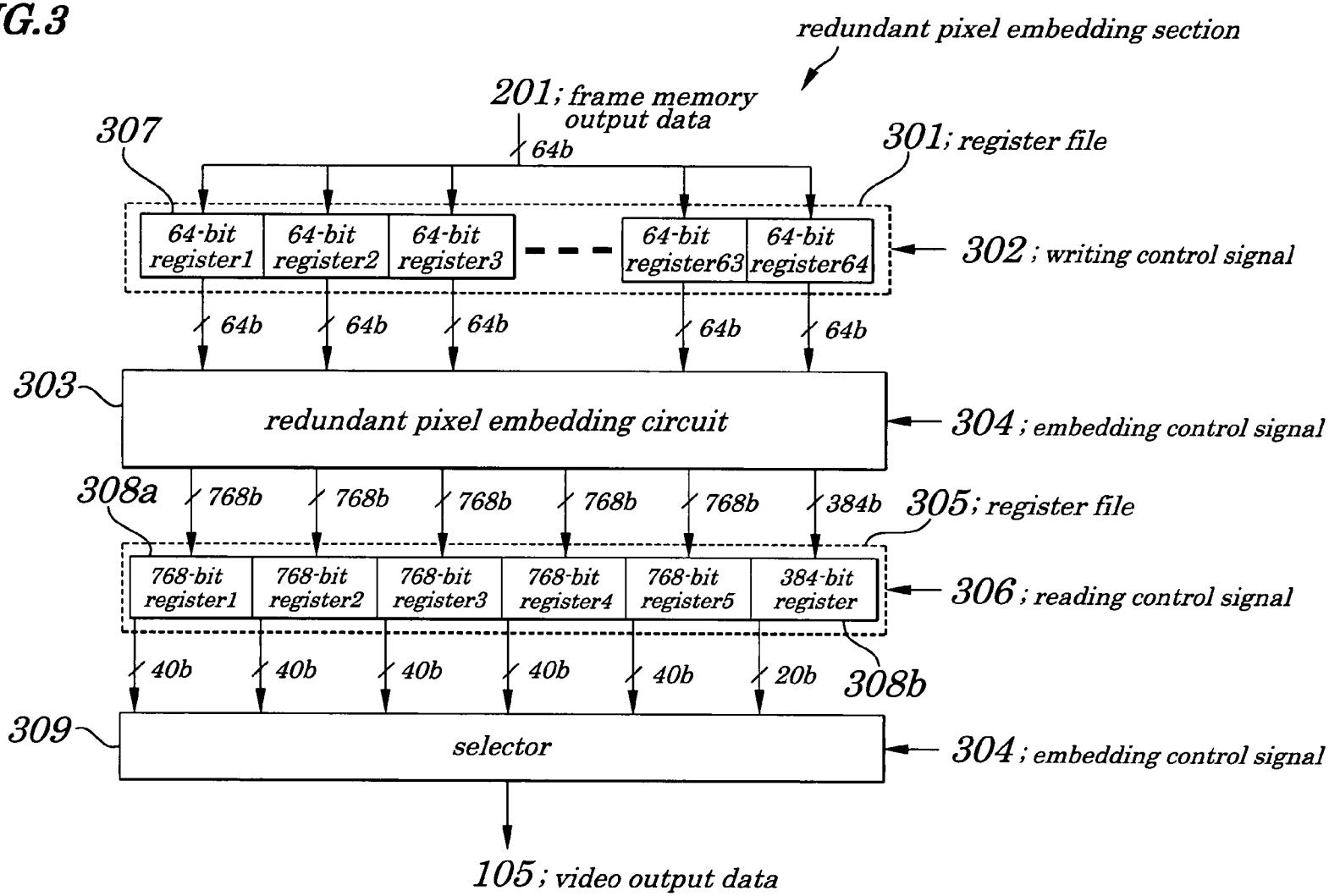
FIG. 3 is a diagram showing a concrete configuration example of the redundant image embedding section in the digital image processing device according to the embodiment of the present invention.
Figure 4:
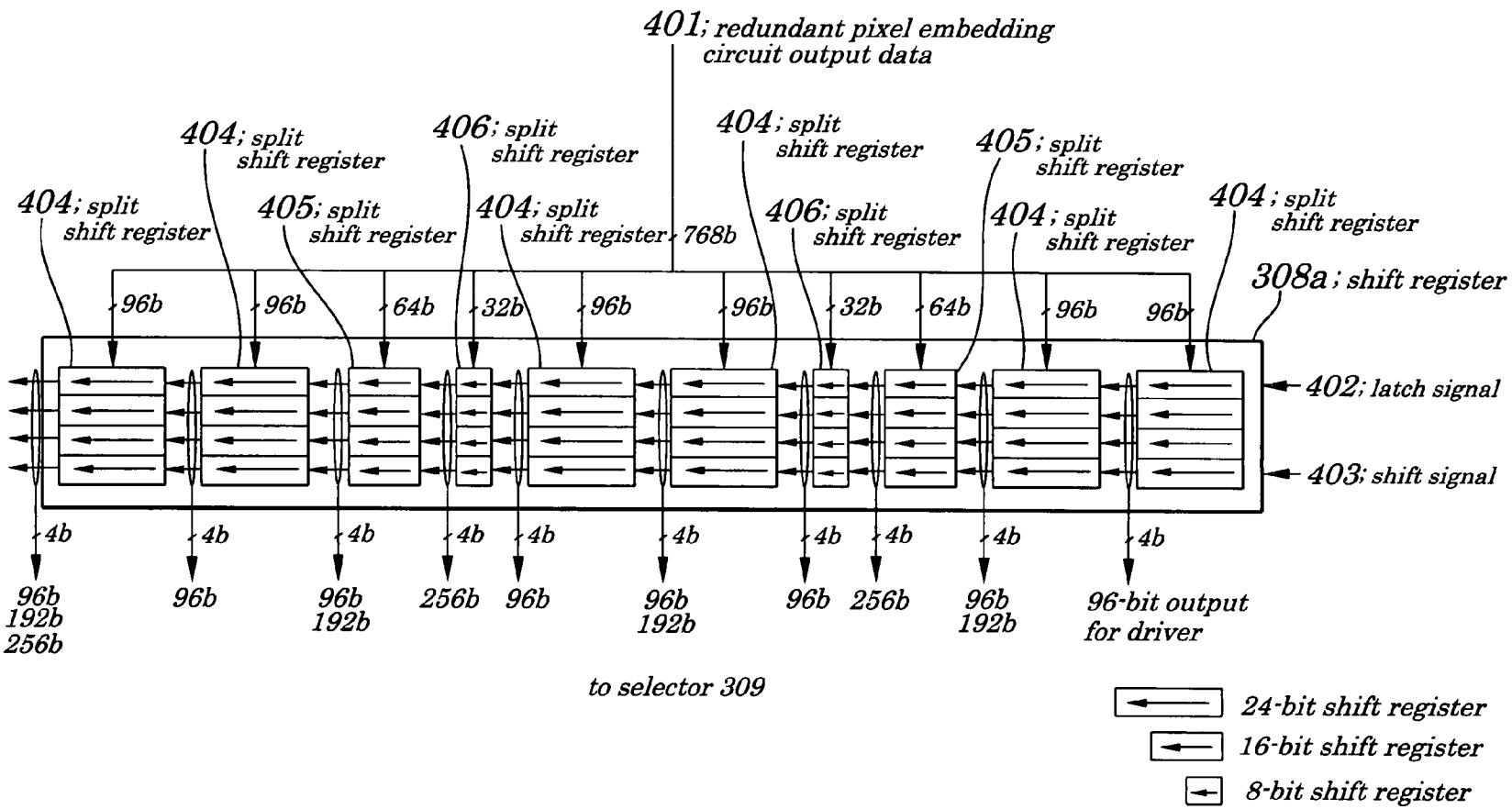
FIG. 4 is a diagram showing a concrete configuration example of a parallel-serial converting circuit in the digital image processing device according to the embodiment of the present invention.
Figure 5A:
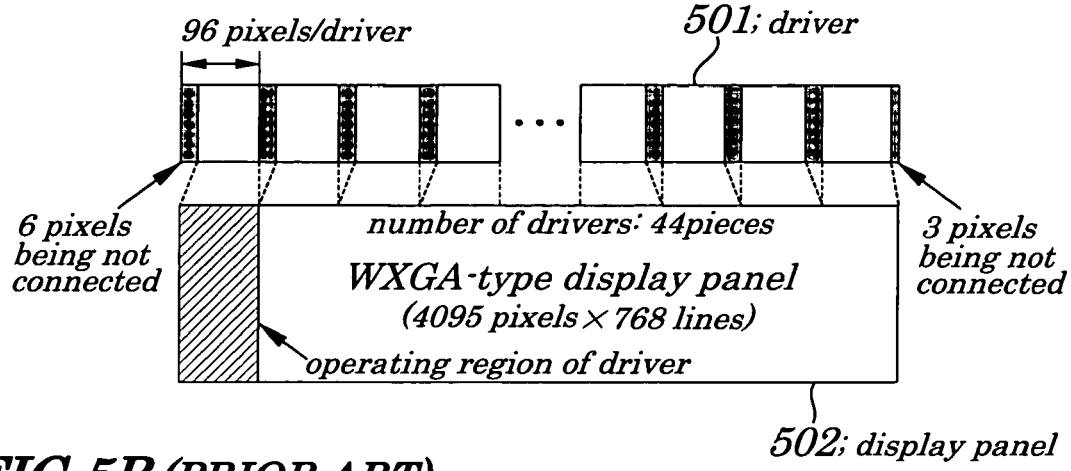
FIG.5A (PRIOR ART)
FIGS. 5A, 5B, and 5C are diagrams showing examples of methods for connecting various display panels and drivers.
Figure 5B:
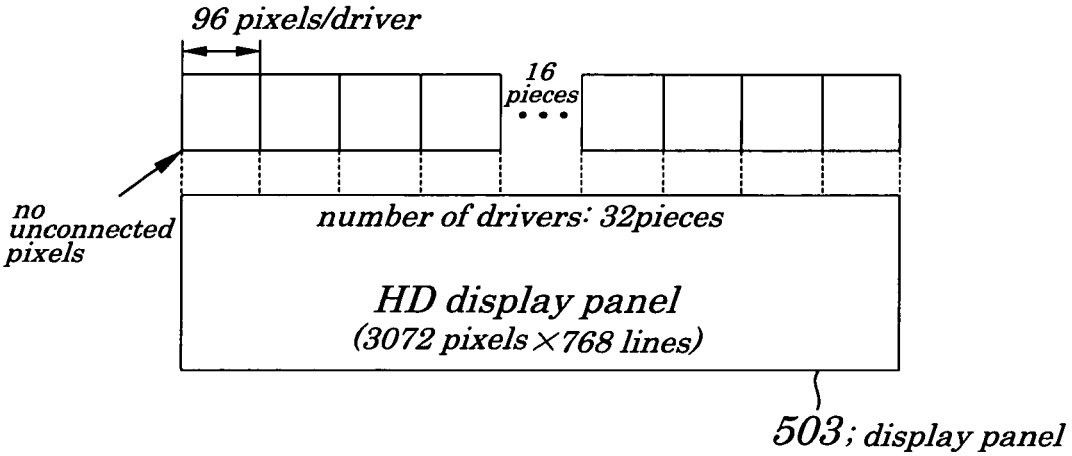
FIG.5B (PRIOR ART)
Figure 5C:
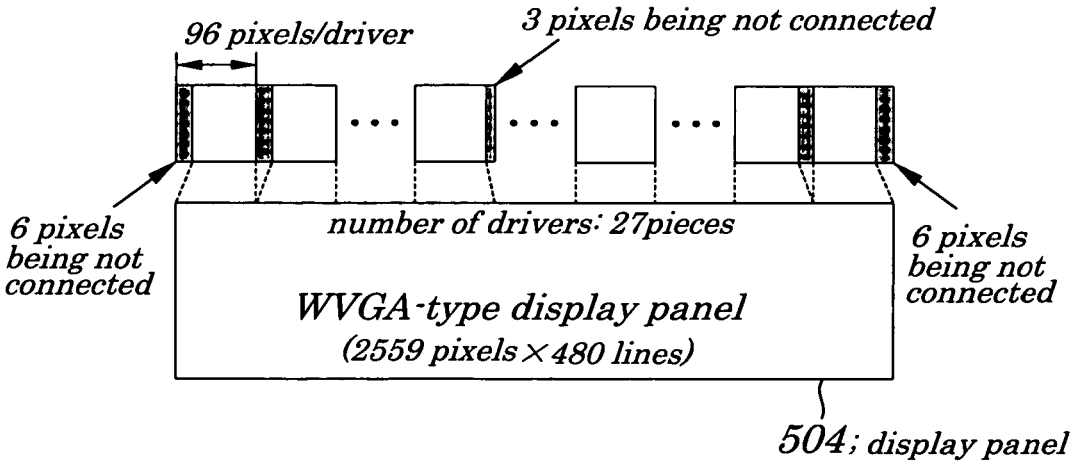
FIG.5C (PRIOR ART)
Figure 6:
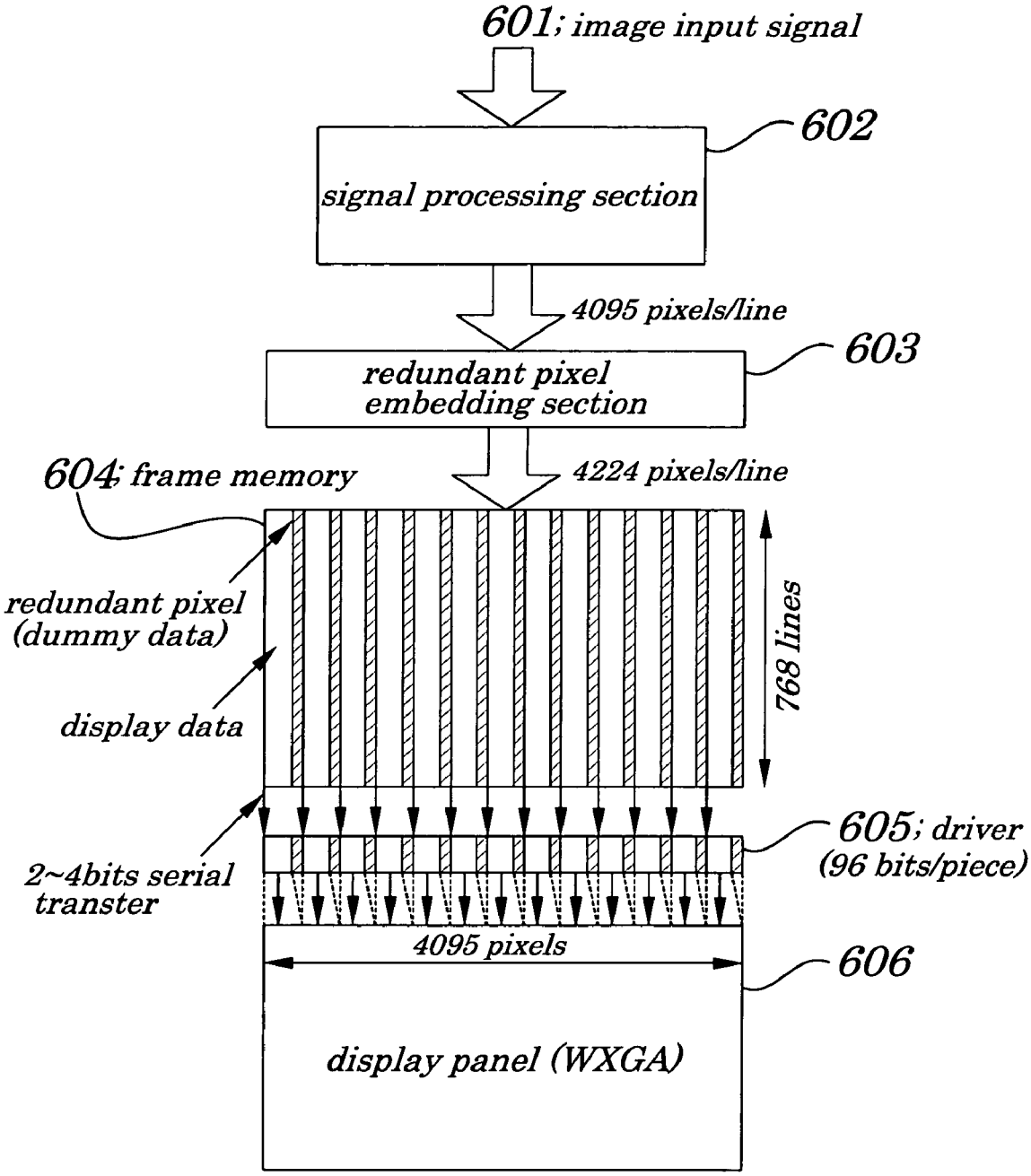
FIG.6 (PRIOR ART)
FIG. 6 is a block diagram showing an example of configurations of a conventional digital image processing device.

FIG. 1 is a block diagram showing basic configurations of a digital image processing device according to one embodiment of the present invention. FIG. 2 is a diagram showing detailed configurations of a redundant image embedding section in the digital image processing device according to the embodiment. FIG. 3 is a diagram showing a concrete example of the redundant image embedding section in the digital image processing device according to the embodiment. FIG. 4 is a diagram showing a concrete example of a parallel-serial converting circuit in the digital image processing device according to the embodiment.

The digital image processing device of the embodiment chiefly includes, as shown in FIG. 1, a signal processing section 102, a frame memory 103, and a redundant pixel embedding section 104. The signal processing section 102, after having performed processing of filtering, or a like, of a video input signal 101, outputs the filtered signal. The frame memory 103 holds image data for each frame. The redundant pixel embedding section 104, after having embedded dummy data in an image line input in a time-series manner, outputs the data as a video output signal 105.

Operations of the digital image processing device shown in FIG. 1 are described below. In the digital image processing device, a video input signal 101, after having been processed by the signal processing section 102, is stored in the frame memory 103 as image data. The frame memory 103 is installed to play a role as a double buffer or a like to smooth out transfer speed discrepancies, for example, between the video input signal 101 and the video output signal 105. The video data read from the frame memory 103, after dummy data has been embedded in the video data by the redundant pixel embedding section 104 and is fed to a display panel (not shown) as the video output signal 105.

The redundant pixel embedding section 104 in the digital image processing device of the embodiment, as shown in FIG. 2, is made up of a serial-parallel converting circuit 202, a redundant pixel embedding circuit 203, and a parallel-serial converting circuit 204. The serial-parallel converting circuit 202, after having converted data input in a time-series manner from serial data to parallel data, outputs the converted data in a unit of an image line in parallel. The redundant pixel embedding circuit 203 embeds dummy data in an image line and outputs the data. The parallel-serial converting circuit 204 parallel-serial converts an image line in which dummy data is embedded and produces a time-series video output signal.

Operations of the redundant pixel embedding section 104 shown in FIG. 2 are described below. In the redundant pixel embedding section 104, a frame memory output data 201 output in a time-series manner from the frame memory 103, after having undergone a serial-parallel conversion by the serial-parallel converting circuit 202, is output in a unit of an image line in parallel. The redundant pixel embedding circuit 203 embeds dummy data in an input image line and outputs the data. The image line in which dummy data is embedded, after having undergone a parallel-serial conversion by the parallel-serial converting circuit 204, is output as the video output signal 105 made up of time-series data.

FIG. 3 is a diagram showing the concrete configuration example of the redundant image embedding section 104 in the digital image processing device according to the embodiment of the present invention. To correspond to a display panel providing an image line with the maximum WXGA-type resolution, the redundant image embedding section 104 includes a register file 301 made up of sixty four pieces of 64-bit registers 307, a redundant pixel embedding circuit 303, a register file 305 made up of five pieces of 768-bit shift registers 308*a* and of one piece of a 384-bit shift register 308*b*, and a selector 309.

Next, operations of the redundant pixel embedding section shown in FIG. 3 are described. The register file 301, according to a writing control signal 302, when sequentially capturing 64-bit data fed as frame memory output data 201 to the register 307 and then capturing an image line with the maximum WXGA resolution (4095 pixels/line), outputs all pixels making up an image line in parallel. In the case of an image line with the WXGA resolution or less, data is stored, for example, in a manner close to the left relative to the register file 301 and a remainder is padded with 0s.

The redundant pixel embedding circuit 303 is constructed based on connection theory and, according to an embedding control signal 304, embeds dummy data in an input image line output from the register file 307. The embedding control signal 304 is used to specify a position of dummy data to be embedded in the image line and may be a decoding signal to specify a resolution of a display panel, a type of driver (the number of pixels operated by one driver), or a like.

The register file 305 captures image lines output from the redundant pixel embedding circuit 303 at a same time, for example, in five pieces of 768-bit shift registers 308*a* each containing 768 pixels and one piece of 384-bit shift register 308*b* containing 384 pixels, whose sum of the pixels is 4224 pixels, in synchronization with a clock in one cycle.

Moreover, the register file 305 performs a shift operation on the captured image line, according to a read control signal 306, in synchronization with a clock. While the shift operation is being performed, the captured image line is output in a time-series manner from 5 pieces of 40-bit shift output terminals and from 1 piece of 20-bit shift output terminal. The selector 309 selects time-series data from the shifted outputs fed from the register file 305 according to an embedding control signal 304, and outputs the data as the video output data 105.

FIG. 4 is a diagram showing a concrete configuration example of a parallel-serial converting circuit in the digital image processing device according to the embodiment of the present invention, and in detail, the shift register 308*a* made up of 96-bit split shift registers 404, 64-bit split shift registers 405, and 32-bit split shift registers 406. Each of the 96-bit split shift registers 404 is made up of 4 pieces of 24-bit shift registers. Each of the 64-bit split shift registers 405 is made up of 4 pieces of 16-bit shift registers. Each of the 32-bit split shift registers 406 is made up of 4 pieces of 8-bit shift registers. Each of the shifted outputs from the split shift registers is connected to each of shifted inputs from adjacent split shift registers, which make up 768-bit shift register as a whole.

The shift register 308*a*, by making a latch signal 402 active, captures redundant pixel embedding circuit output data 401 in one cycle in synchronization with a clock and performs a shifting operation, by making a shift signal 403 active, in synchronization with a clock. The split shift register 404 provides a shift length of twenty-four bits and, therefore, input data is shifted out by twenty-four times shifting operations.

Similarly, the split shift register 405 provides a shit length of sixteen bits and, therefore, input data is shifted out by sixteen times shifting operations. The split shift register 406 provides a shift length of 8 bits and, therefore, input data is shifted out by 8 times shifting operations. Shift data of 4 bits is output from each of the split shift registers 404, 405, and 406 as an output corresponding to each of 96-bit, 192-bit and, 256-bit data drivers and is fed to a selector 309.

In FIGS. 3 and 4, if an image line has a maximum WXGA resolution and corresponds to each of the 96-bit, 192-bit, and 256-bit data drivers, shift-out data output from the shift register 308*a* shown in FIG. 4 is input to the selector 309 shown in FIG. 3 which selects suitable shift-out data according to an embedding control signal 304. However, the embedding control signal 304 has to contain a signal to specify a type of a driver, in addition to a signal to specify a resolution, both of which are required for embedding dummy data in the redundant pixel embedding circuit 303.

It is apparent that the present invention is not limited to the above embodiments but may be changed and modified without departing from the scope and spirit of the invention. For example, in the above embodiment, the digital image processing device of the present invention is described in detail using a case of employing the WXGA resolution. However, the present invention may be applied not only to display panels with HD resolutions or WVGA resolutions being commercially available presently but also to display panels using a combination of a desired level of a resolution employed in the display panel and any type of driver employed in the display panel being expected to appear in the market in future.

What is claimed is:

1. A digital image processing device for signal-processing a video input signal and supplying a video output signal to a display panel, comprising:

a signal processing unit to process said video input signal;

a frame memory to store the processed video input signal from said signal processing unit; and a driver including a redundant pixel embedding circuit to embed data as redundant pixels into an image line read from said frame memory so as to produce said video output signal, said data corresponding to portions of said video input signal irrespective of data values of said portions.

2. The digital image processing device according to claim 1, wherein said redundant pixel embedding circuit has a function of receiving, as an input, an image line read from said frame memory and of embedding, according to an embedding control signal fed from outside, a redundant pixel in a specified position in said image line.

3. A digital image processing device for signal-processing a video input signal and supplying a video output signal to a display panel, comprising:

a signal processing unit to process said video input signal;

a frame memory to store the processed video input signal from said signal processing unit;

a serial-parallel converting circuit to receive image data read from said frame memory in a time-series manner and to produce an output making up an image line, a driver including a redundant pixel embedding circuit to embed data as redundant pixels into said image line so as to output data, said embedded data corresponding to portions of said video input signal irrespective of data values of said portions, and a parallel-serial converting circuit to output said image line in which said redundant pixel is embedded as time-series image data.

4. The digital image processing device according to claim 3, wherein said serial-parallel converting circuit which is made up of a register file being able to store an image line and which has a function of sequentially storing image data fed from said frame memory in a time-series manner according to a writing control signal fed from outside and of reading, simultaneously and in parallel, contents of all registers in said register file.

5. The digital image processing device according to claim 3, wherein said redundant pixel embedding circuit has a function of receiving, as an input, said image line read from said serial-parallel converting circuit and of embedding, according to an embedding control signal fed from outside, a redundant pixel in a specified position in said image line.

6. The digital image processing device according to claim 3, wherein said parallel-serial converting circuit has a register file made up of two or more shift registers and a selector to select an output from each of said shift registers and to output the selected output and wherein said register file is able to store an image line in one clock cycle and wherein each of said shift registers is able to perform a shifting operation, according to a reading control signal fed from outside, in synchronization with a clock signal and wherein said selector has a function of selecting s specified shift output from said shift register and of outputting the selected output according to an embedding control signal fed from outside.

7. The digital image processing device according to claim 6, wherein each of said shift registers is made up of two or more split shift registers and wherein each of said split shift registers receives a data input, shift data input, latch signal input, and shift signal input and produces a shift data output and wherein each of said shift registers has a function of writing, when data is to be written to said split shift registers, data at one time, by making active a latch signal input, in synchronization with a clock and, at time of shifting operations, of performing said shifting operation for data, by making active a shift signal input, in synchronization with a clock and of feeding a shift output fed from each of said split shift registers to said selector by connecting a terminal for a shift output from each of said split shift registers to a terminal for a shift input of each of adjacent split shift registers to allow said shift register to perform said shift operation as a whole.

8. A digital image processing device for signal-processing a video input signal and supplying a video output signal to a display panel, comprising:

a signal processing means to process said video input signal;

a frame memory to store the processed video input signal from said signal processing means, and a driver including redundant pixel embedding means to embed data as redundant pixels into an image line read from said frame memory so as to produce said video output signal, said data corresponding to portions of said video input signal irrespective of data values of said portions.

9. The digital image processing device according to claim 8, wherein said redundant pixel embedding means has a function of receiving, as an input, an image line read from said frame memory and of embedding, according to an embedding control signal fed from outside, a redundant pixel in a specified position in said image line.

10. A digital image processing device for signal-processing a video input signal and supplying a video output signal to a display panel, comprising:

a signal processing means to process said video input signal;

a frame memory to store the processed video input signal from said signal processing means;

a serial-parallel converting means to receive image data read from said frame memory in a time-series manner and to produce an output making up an image line, a driver including redundant pixel embedding means to embed data as redundant pixels into said image line so as to output data, said embedded data corresponding to portions of said video input signal irrespective of data values of said portions, and a parallel-serial converting means to output said image line in which said redundant pixel is embedded as time-series image data.

11. The digital image processing device according to claim 10, wherein said serial-parallel converting means which is made up of a register file being able to store an image line and which has a function of sequentially storing image data fed from said frame memory in a time-series manner according to a writing control signal fed from outside and of reading, simultaneously and in parallel, contents of all registers in said register file.

12. The digital image processing device according to claim 10, wherein said redundant pixel embedding means has a function of receiving, as an input, an image line read from said serial-parallel converting means and of embedding, according to an embedding control signal fed from outside, a redundant pixel in a specified position in said image line.

13. The digital image processing device according to claim 10, wherein said parallel-serial converting means has a register file made up of two or more shift registers and a selector to select an output from each of said shift registers and to output the selected output and wherein said register file is able to store an image line in one clock cycle and wherein each of said shift registers is able to perform a shifting operation, according to a reading control signal fed from outside, in synchronization with a clock signal and wherein said selector has a function of selecting a specified shift output from said shift register and of outputting the selected output according to an embedding control signal fed from outside.

14. The digital image processing device according to claim 13, wherein each of said shift registers is made up of two or more split shift registers and wherein each of said split shift registers receives a data input, shift data input, latch signal input, and shift signal input and produces a shift data output and wherein each of said shift registers has a function of writing, when data is to be written to said split shift registers, data at one time, by making active a latch signal input, in synchronization with a clock and, at time of shifting operations, of performing said shifting operation for data, by making active a shift signal input, in synchronization with a clock and of feeding a shift output fed from each of said split registers to said selector by connecting a terminal for a shift output from each of said split shift registers to a terminal for shift input of each of adjacent split shift registers to allow said shift register to perform said shift operation as a whole.

* * * * *